United States Patent [19]

Tarrall et al.

[11] 4,029,381

[45] June 14, 1977

[54] ELECTRICAL CONNECTOR

[75] Inventors: Mahone T. Tarrall; Michael D. Patzer, both of Boulder, Colo.

[73] Assignee: Valleylab, Inc., Boulder, Colo.

[22] Filed: Jan. 16, 1976

[21] Appl. No.: 649,623

[52] U.S. Cl. ..... 339/61 R

[51] Int. Cl.[2] ..... H01R 13/62

[58] Field of Search ..... 339/59–63, 339/74, 176 P, 184, 186, 195 A, 196 A, 200 P, 255 P, 260, 261

[56] References Cited

UNITED STATES PATENTS

| | | | |
|---|---|---|---|
| 2,755,452 | 7/1956 | Rogie | 339/196 A |
| 3,039,075 | 6/1962 | Stollman | 339/184 R |
| 3,699,495 | 10/1972 | Raynor | 339/128 |
| 3,774,143 | 11/1973 | Lopin | 339/61 R |
| 3,899,239 | 8/1975 | Allard | 339/255 P |
| 3,914,007 | 10/1975 | Seidler | 339/255 P |
| 3,937,546 | 2/1976 | Clewes et al. | 339/61R |

*Primary Examiner*—Joseph H. McGlynn
*Attorney, Agent, or Firm*—O'Rourke, Harris & Hill

[57] ABSTRACT

A single or multichannel electrical connector including a male connector having at least two prongs depending resiliently from a base, the prongs each having defined in the outer edge thereof a narrow notch with at least one of the notches having at least one conductor exposed at the bottom portions of the notch, the conductor extending internally through the prong, the prongs also having end portions with outwardly facing mutually inclined surfaces, the male connector being adapted to fit a female connector having an opening defined therethrough the configured to receive the prongs with the sides of the notches and the connector at the bottom of the notch engaging a protruding contact in a sidewall of the opening in the female connector such that the male connector may be inserted by engaging the opposed inclined planes of the prongs within the opening of the female connector, deforming the prongs towards one another to pass through the female connector thereupon again expanding the prongs to bring the contact of the female connector into engagement with the conductor of the male connector with the notches also engaging the front and back end walls of the female connector contact to secure the male connector therein. In the event more than one conductor is provided in a prong, the prong may be formed of independent sections.

5 Claims, 6 Drawing Figures

ELECTRICAL CONNECTOR

BACKGROUND OF THE INVENTION

1. Field of the Invention.

The present invention relates generally to electrical connectors and more particularly to a deformable, conveniently produced, electrically and mechanically secure connector.

2. Description of the Prior Art.

Electrical connectors have been produced in almost enumerable shapes and configurations. The more complex connectors may involve recessed electrical conductors and positive locking between the connectors requiring, for instance, either an integral or separate tool to permit the connectors to be released.

The more simple, common connectors often involve exposed electrides and detents which loosely fix the connectors together but which are displaceable to permit parting of the connectors.

Among the more desirable features not readily obtained in a single connector are recessed or protected electrodes, positive interlocking with convenient connecting and parting of the connector, and simplicity of manufacture with modestly priced materials.

SUMMARY OF THE INVENTION

The present invention, which provides a heretofore unavailable combination of desirable features over previous electrical connectors, comprises a male connector having at least two prongs depending deformably from a base, the prongs having outwardly oriented inclined planes at the ends thereof and relatively notches defined therein with one or more conductors exposed within at least one of the notches. The connector is readily joined by inserting the prongs in the opening of a female connector by elastic deformation of the prongs as the opposed inclined planes move into the female connector with, upon positioning within the female connector, the notches and each conductor of the male connector engage a contact protruding from the sidewalls of the opening within the female connector to thus provide a sure interlock between the connectors and as well as excellent and certain electrical contact between the connectors.

Accordingly, an object of the present invention is to provide a new and improved electrical connector.

Another object of the present invention is to provide a new and improved electrical connector which may be positively interlocked with assured electrical contact.

Yet another object of the present invention is to provide a new and improved electrical connector which may be conveniently disengaged.

Still another object of the present invention is to provide a new and improved electrical connector which positively engages the electrical contacts of the connector portions.

Yet another object of the present invention is to provide a new and improved electrical connector which may be formed of economical, polymeric material.

Still another object of the present invention is to provide a new and improved electrical connector which may be formed by injection molding.

These and other objects and features of the present invention will become apparent from the following descriptions.

DETAILED DESCRIPTION OF THE INVENTION

Figure 1:
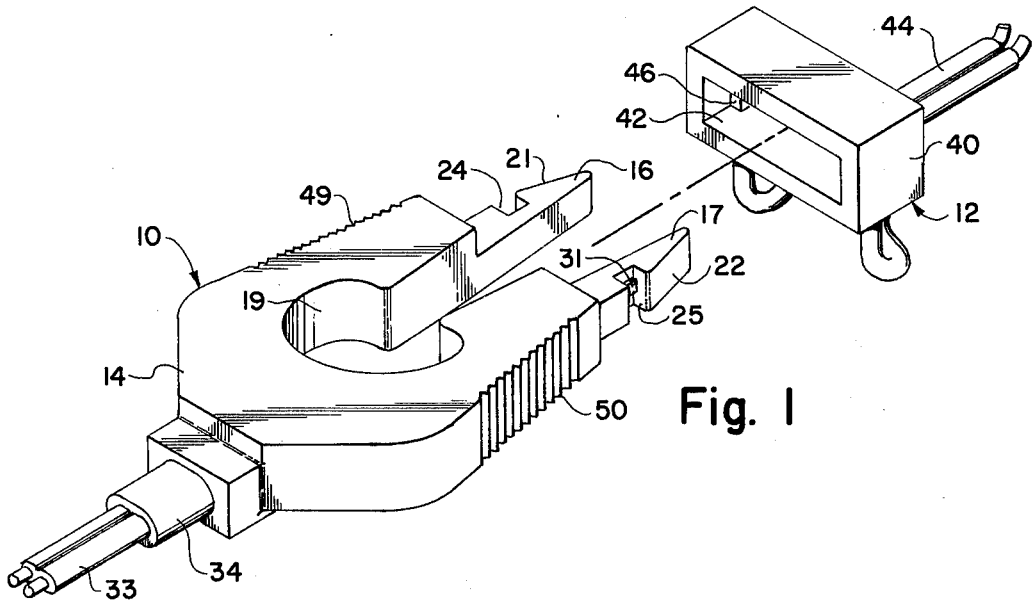
FIG. 1 is a perspective view of a male connector and complementary female connector in accordance with the present invention.

Turning now to the drawing, wherein similar components are designated by like reference numerals throughout the various figures, a connector according to the instant invention is illustrated in FIG. 1 with the male connector portion generally designated by the reference numeral 10 and the female connector portion generally designated by the reference numeral 12. As shown in FIG. 1, male connector 10 is a longitudinally symetrical bifurcated connector having a base portion 14, and left and right prongs 16 and 17 respectfully. Prongs 16 and 17 are preferably delineated in part by keyhole shaped opening 19 defined through connector 10. Opening 10 is preferred to lend elastic deformation to connector 10 but prongs 16 and 17 are inherently deformed. Each of prongs 16 and 17 have opposed inclined surfaces 21 and 22 defined on the end portions thereof. As can be seen in more detail in FIGS. 2 and 3, prongs 16 and 17 have defined therein immediately behind inclined surfaces 21 and 22 notches 24 and 25 respectively. Electrodes 30 and 31 are exposed to the bottom of notches 24 and 25. Two channel cord 33 is, in part, formed internally of male connector 10 by entering through sleeve 34, and bifurcates to join electrodes 30 and 31 at joints 35 and 36 respectfully.

Figure 2:
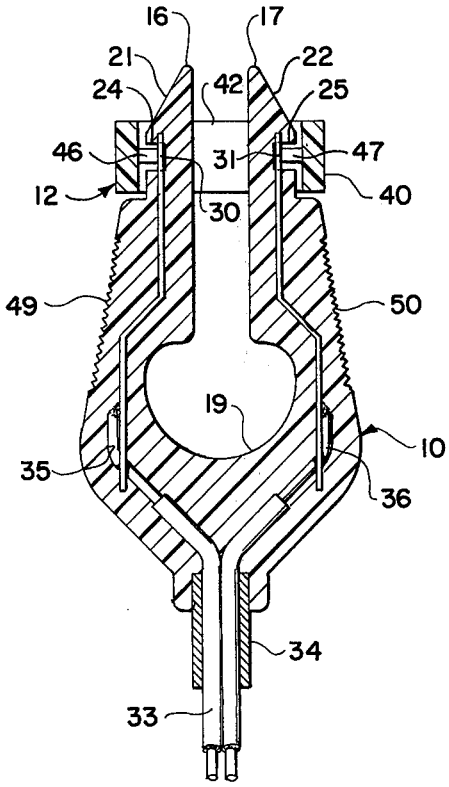
FIG. 2 is a sectioned top view of the male and female connectors of FIG. 1 in an engaged relationship.

Female connector 12, as shown in FIGS. 1 and 2, is formed of, for instance, block 40 having opening 42 defined therein. Two channel cord 44 is connected to left contact 46 and right contact 47 formed in block 40 and exposed in the sidewalls of opening 42.

As shown particularly well in FIG. 2, male connector 10 engages female connector 12 by passing prongs 16 and 17 into opening 42 and thereafter spreading prongs 16 and 17 to engage contacts 46 and 47 by the walls of notches 24 and 25. As prongs 16 and 17 spread outward, contacts 46 and 47 of female connector 12, which are in the form of protruding electrical conductors, contact electrodes 30 and 31 of male connector 10. Since prongs 16 and 17 are somewhat distended from the relaxed position, electrodes 30 and 31 are urged with positive force into electrical engagement with contacts 46 and 47.

As in apparent from FIG. 2, male connector 10 is securely positioned within female connector 12 as a result of notches 24 and 25 interlocking with contacts 46 and 47 which protrude from opening 42 a greater distance than the depth of notches 24 and 25. However, male connector 10 may be conveniently and readily removed from female connector 12 by grasping male connector 10 at grooved areas 49 and 50 and compressing yieldable prongs 16 and 17 together to release notches 24 and 25 from contacts 46 and 47 to facilitate withdrawal of male connector 10 from female connector 12.

Figure 3:
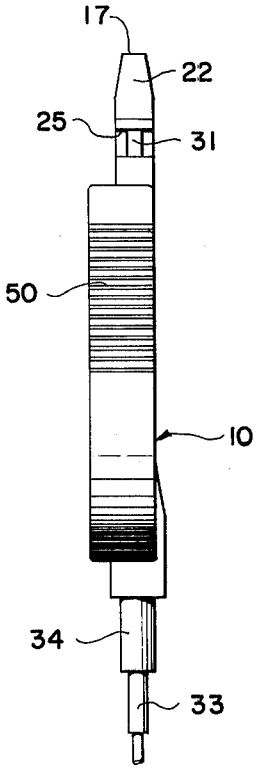
FIG. 3 is a side view of the male connector of FIG. 1.

As shown in FIGS. 2 and 3, electrodes 30 and 31 are not readily contacted by a user even if male connector 10 as inadvertently grasped within notches 24 and 25 since electrodes 30 and 31 are positioned at the central portion of the bottom of notches 24 and 25 which are relatively narrow to preclude admission of a user's hand or fingers.

Figure 4:
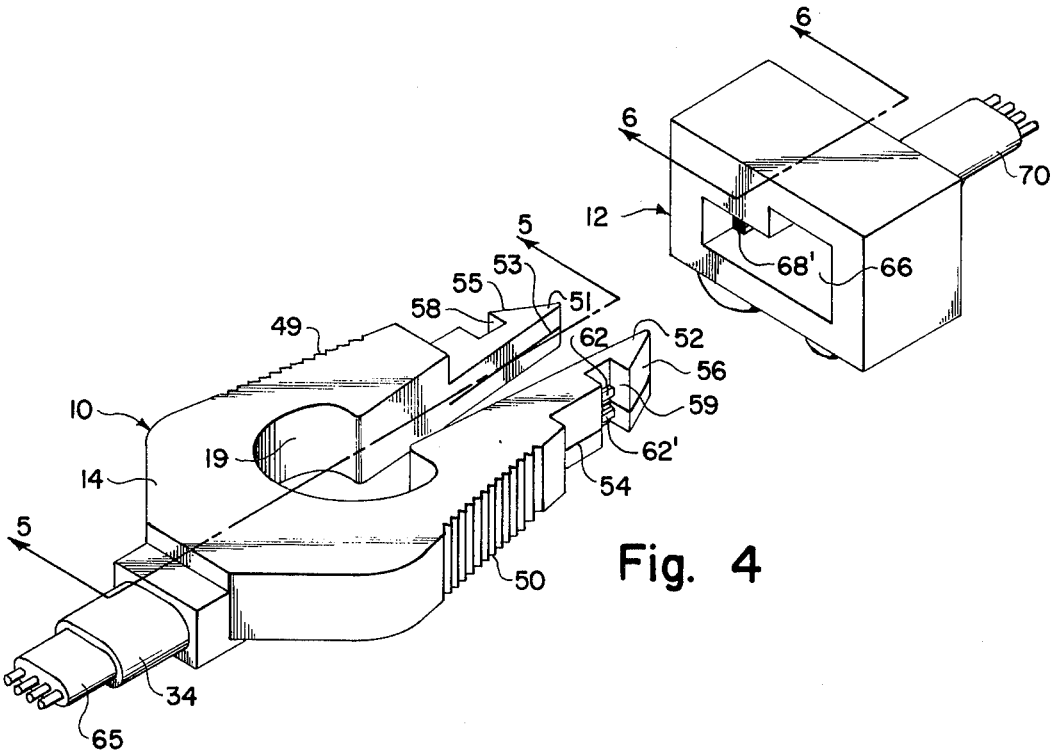
FIG. 4 is a perspective view of multichannel male and female connectors in accordance with the present invention.
Figure 5:
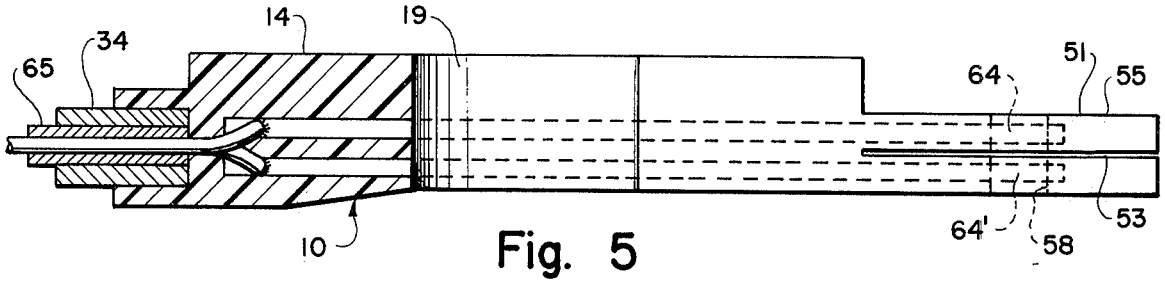
FIG. 5 is a centrally sectioned side view of the male connector of FIG. 4.
Figure 6:
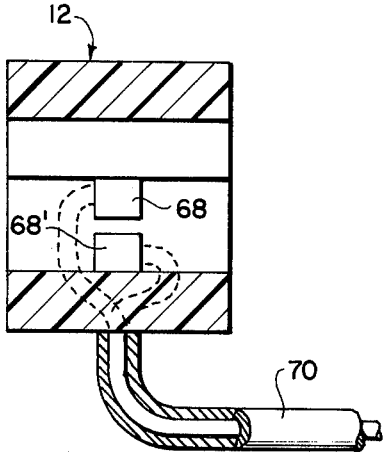
FIG. 6 is a centrally sectioned side view of the female connector of FIG. 4.

Some of the more apparent variations on the concept of the instant invention are illustrated in FIGS. 4 through 6. As shown in FIG. 4, male connector 10 is, in essence, as described above with base 14, keyhole opening 19 and grooved areas 49 and 50. However, prongs 51 and 52 are of different thicknesses and have slits 53 and 54 extending therethrough. Inclined surfaces 55 and 56 and notches 58 and 59 are essentially of the configuration and for the purposes described above. However, as shown in FIGS. 4 and 5, conductors 62, 62', 64 and 64' are positioned in the bottom of notches 59 and 58 respectively. Thus it will be seen that four conductors 62, 62', 64 and 64' are provided and situated in a manner rather similar to that previously discussed with regard to FIGS. 1, 2 and 3 with the additional feature of two conductors being exposed in each notch. As shown particularly well in FIG. 7, conductors 64 and 64' extend through base 14, sleeve 34 to four channel cord 65.

Female connector 12 is also somewhat modified. L-shaped opening 66 is defined in female connector 12 in such a manner as to admit prongs 51 and 52 only in the orientation illustrated in FIG. 4. Obviously, if male connector 10 is rotated 180 degrees around the longitudinal axis, prong 52 will not fit into the narrow portion of L-shaped opening 66. Independent contacts 68 and 68' are provided on each inner sidewall of L-shaped opening 66 to receive, as illustrated in FIGS. 4 and 5, conductors 64 and 64' respectively. Since prong 51 is sectioned along its length by slit 53, conductors 64 and 64' independently bear against contacts 68 and 68'. Thus, while basically utilizing the configuration of FIGS. 1 through 3, the embodiment of FIGS. 4 through 6 provide for four channel electrical interconnection, with polarized probes and independent urging of each male connector conductor against the appropriate female connector contact.

Summarily, the connectors of the instant invention may be readily produced by inserting conductors and/or contacts with joined cords into a die cavity, injecting, for instance, high density polypropylene to form the connectors, and simply removing the formed connectors from the die after cooling. The simplicity does not in any way compromise the certainty of connection, i.e., with the notches of the male connector positively interfacing with the front and back side portions of the female connector contacts and the electrical conductors of the male conductor are thus necessarily urged positively into contact with the contacts of the female connector. But even with such positive physical and electrical interconnection, the connectors may be readily removed by merely grasping the male connector, elastically deforming the prongs towards one another, and withdrawing the male connector from the female connector. Thus not only simplicity and economy are provided, but the performance is equal to, and in many cases superior to, much more complicated forms of electrical connectors.

Although but several of the numerous possible embodiments of the present invention have been illustrated and describe, it is anticipated that various changes and modifications will be apparent to those skilled in the art, and that such changes may be made without departing from the scope of the invention as defined by the following claims.

What is claimed is:

1. An electrical connector combination comprising: a male connector comprising a base portion, at least two substantially parallel resilient prongs extending from the base portion, a notch defined in the outer side portion of each prong, at least one electrical conductor positioned within each prong and exposed at the bottom portion of the notch defined in the prong, and outwardly facing inclined surfaces defined between the terminus of each prong and the notch defined therein, the inclined surfaces extending to the terminus of each prong and being in a diverging relationship from the termini of the prongs to the notches defined in the prongs; a female connector comprising a member having an opening with opposed sidewalls and of a depth greater than the width of the notches in the prongs defined therein and adapted to receive the prongs of the male connector, the width of the opening being greater than the greatest distance between the termini of the prongs, and at least one protruding electrical contact narrower than the width of the notches positioned on each internal sidewall of the opening and adapted to bear upon the exposed conductor of the male connector and fit between the sidewalls of a notch when the male connector is situated in the female connector; whereby, the male connector may be inserted into the female connector by elastically deforming the prongs together as the inclined surfaces bear upon the opening in the female connector upon insertion of the prongs into the opening defined in the female connector, and permitting the prongs to expand thereby positioning the male connector by means of the side edges of the notches bearing upon the electrical contacts in the female connector with the exposed conductors in the bottom of the notches also bearing upon the contacts.

2. An electrical connector combination as set forth in claim 1 in which each conductor in the male connector is positioned flush with and extending across the bottom of the notch defined in the prong, and the contact of the female connector is in the form of a rectilinear electrical conductant material extending from the sidewall of the opening of the female conductor in a direction transverse to that in which the male connector enters the female connector.

3. An electrical connector combination as set forth in claim 1 in which one of the prongs is of a differing cross-section than the other of the prongs and the opening defined in the female connector is similarly different in cross-section on one side of the opening than on the other side, whereby the prongs of the male connector may be inserted into the opening defined in the female connector in only one orientation.

4. An electrical connector combination as set forth in claim 1 in which at least one prong of the male connector carries two conductors and the female connector has at least two independent contacts disposed in at least one sidewall of the opening defined in the female connector.

5. An electrical connector as set forth in claim 4 in which each prong carrying at least two conductors is longitudinally divided between the conductors, whereby each portion of the divided prong is adapted to independently urge each conductor against the associated electrical contact in the female connector.

* * * * *